United States Patent [19]

Loladze et al.

[11] Patent Number: 5,003,728

[45] Date of Patent: Apr. 2, 1991

[54] MACHINE FOR ABRASIVE TREATMENT

[75] Inventors: Teimuraz N. Loladze; Boris I. Batiashvili; Gennady L. Mamulashvili; David S. Butskhrikidze; Georgy J. Grdzelishvili; Jury I. Markevich, all of Tbilisi, U.S.S.R.

[73] Assignee: Vsesojuzny Nauchno-Issledovatelsky I Proektno-Konstruktorsky Institut Atomnogo Energeticheskogo Machinostroenia USSR, Moscow, U.S.S.R.

[21] Appl. No.: 283,369

[22] PCT Filed: Jul. 31, 1987

[86] PCT No.: PCT/SU87/00084

§ 371 Date: Nov. 7, 1988

§ 102(e) Date: Nov. 7, 1988

[87] PCT Pub. No.: WO88/06949

PCT Pub. Date: Sep. 22, 1988

[30] Foreign Application Priority Data

Mar. 10, 1987 [SU] U.S.S.R. ..... 4201397

[51] Int. Cl.[5] ..... B24B 49/00

[52] U.S. Cl. ..... 51/165.8; 51/165.9; 51/131.1; 51/131.4

[58] Field of Search ..... 51/131.1, 131.3, 131.4, 51/109 R, 121, 123 R, 133, 134, 165.77, 165.78, 165.8, 165.81, 165.9

[56] References Cited

U.S. PATENT DOCUMENTS

| | | | |
|---|---|---|---|
| 2,399,924 | 5/1946 | Hayward | 51/109 |
| 3,031,806 | 5/1962 | Jones | 125/11 R X |
| 3,110,988 | 11/1963 | Boettcher . | |
| 3,374,582 | 3/1968 | Boettcher | 125/11 R X |
| 3,780,921 | 1/1973 | Cronkhite et al. | 51/131.4 |
| 3,930,343 | 1/1976 | Welsch et al. . | |
| 3,968,598 | 7/1976 | Ogawa . | |
| 4,271,635 | 6/1981 | Szalay | 51/109 R X |
| 4,481,741 | 11/1984 | Bouladon et al. . | |

FOREIGN PATENT DOCUMENTS

| | | | |
|---|---|---|---|
| 1601415 | 10/1970 | France . | |
| 0065071 | 5/1980 | Japan | 51/131.3 |
| 0199355 | 9/1987 | Japan | 51/131.4 |
| 0277264 | 12/1987 | Japan | 51/131.4 |
| 1104762 | 4/1979 | U.S.S.R. . | |
| 679375 | 8/1979 | U.S.S.R. . | |
| 0931422 | 6/1982 | U.S.S.R. | 51/131.4 |
| 1151437 | 4/1985 | U.S.S.R. | 51/131.4 |
| 1409776 | 10/1975 | United Kingdom . | |

*Primary Examiner*—J. J. Hartman
*Assistant Examiner*—M. Rachoba
*Attorney, Agent, or Firm*—Fleit, Jacobson, Cohn, Price, Holman & Stern

[57] ABSTRACT

The machine for abrasive treatment comprises an abrasive tool (1) and a device for establishing the holding-down force within the machining zone, said device having a housing (3) provided with guideways, wherein poppet sleeves (4) carrying spindles (5) are free to reciprocate so as to translate the holding-down force to the abrasive tool (1), and a feed mechanism (14) located on the housing (3). According to the invention, in the device for establishing the holding-down force the poppet sleeves (4) are interlinked through an elastic member which is regidly coupled to the feed mechanism (14), while the latter mechanism is adapted to damp the travel of the elastic member in the forward and reverse directions of feed. According to an equivalent embodiment of the invention, in the device for establishing the holding-down force the poppet sleeves (4) are interlinked through at least one elastic member (11*a*) which is regidly coupled to said poppet sleeves, while the feed mechanism (14) is associated with the elastic member (11*a*) and is adapted to damp the travel of the elastic member (11*a*) in the forward and reverse directions of feed.

3 Claims, 6 Drawing Sheets

MACHINE FOR ABRASIVE TREATMENT

TECHNICAL FIELD

The present invention relates generally to abrasive treatment and more specifically, to machines for such treatment.

BACKGROUND ART

One prior-art device for lapping various components (U.S. Pat. No. 3,968,598) is known to comprise an abrasive tool and an appliance aimed at building up a holding-down force within the cutting zone, said appliance having a housing with a guideway, wherein a poppet sleeve carrying a spindle is free to reciprocate so as to translate the holding-down force to the abrasive tool. Feed motion is effected by means of a hand-driven toggle-arm mechanism.

The workpiece-to-abrasive-tool holding-down force in the aforediscussed device is constant and independent of the abrasive tool profile. Such a construction results in that the workpiece being machined "traces" the profile of the tool working portion, which makes it impossible to correct the geometrical shape of the tool working surface in the course of machining and thereby fails to provide high machining accuracy without a separate operation of additional tool dressing.

One state-of-the-art machine for grinding and polishing flat and plain workpiece surfaces (SU, A, No. 679,375) is known to comprise an abrasive tool and an appliance for creating a holding-down force within the machining zone, said appliance having a housing provided with guideways, wherein poppet sleeves carrying spindles are free to reciprocate so as to translate the holding-down force to the abrasive tool. Besides, each of the poppet sleeves has its own spring.

In the above-described machine the workpiece-to-abrasive-tool holding-down forces are applied independently of one another. Therefore there occurs "tracing" of the tool working surface profile by the workpieces being machined, which also makes it impossible to correct the geometrical shape of the tool working surface in the process of machining and thereby fails to provide high machining accuracy without a separate operation of additional dressing.

One more machine for grinding and lapping flat and plain surfaces (U.S. Pat. No. 3,110,988) is known to comprise an abrasive tool and an appliance for establishing a holding-down force. Special dressing rings are freely placed on the abrasive tool surface with a possibility of rotating in the opposite directions.

Since the holding-down force is established within the machining zone by virtue of own weight of the dressing rings there occurs "tracing" of the profile of the tool working surface by the dressing rings, which precludes elimination of camming action of the macroirregularities on the abrasive tool working surface, in particular, waviness (when the wave length exceeds the dressing ring diameter) and hence makes it impossible to correct the geometrical shape of the tool working surface in the course of workpice machining which in turn fails to provide high machining accuracy without a separate operation of additional dressing.

The closest to the machine of the invention is a device for grinding flat and plain surfaces (SU, A, No. 1; 104,762). The device comprises an abrasive tool and an appliance for establishing a holding-down force within the machining zone, said appliance having a housing with guideways, wherein poppet sleeves carrying spindles are free to reciprocate in order to translate the holding-down force to the abrasive tool and the feed mechanism provided on the housing. The spindles are secured, with their stationary portions, on a rigid cross-arm. With such a construction of the appliance for establishing a holding-down force, all spindles carrying the work-pieces being machined are made simultaneously to withdraw from the abrasive tool upon contacting of the components of one of the spindles with protruding irregularities on the abrasive tool working surface. As a result, the forces applied to each of the spindles are added together to give a total value of the force applied at the place of contact. Thus, a possibility is provided of correcting the grinding wheel geometric shape. However this affects adversely both workpieces' machining accuracy und quality of their surface finish, since the workpieces withdrawn from the abrasive tool sustain impact loads upon cyclic getting in contact with said tool, which entails disturbance of the geometric shape of the machined surface, e.g., flatness, as well as its mutilation, such as spalling, broken-off egdes and even complete destruction of the whole workpieces, this being especially the case when machining thin workpieces.

Moreover, increased fitting clearances in the guideways of the poppet sleeves might lead to a deteriorated geometric shape of the abrasive tool rather than its improvement, e.g., disturbed flatness in a radial direction (the so-called "tilt" of a grinding wheel).

SUMMARY OF THE INVENTION

The object of the present invention is to provide such a machine for abrasive treatment that would be capable of higher work-pieces' machining accuracy with a simultaneous correction of the geometric shape of the abrasive tool working surface in the course of machining.

The aforesaid object is accomplished due to the fact that in a machine for abrasive treatment, comprising an abrasive tool and a device for establishing a holding-down force within the machining zone, said device having a housing with guideways, wherein poppet sleeves carrying spindles are free to reciprocate so as to translate the holding-down force to the abrasive tool, and a feeding mechanism located on the housing, according to the invention, the poppet sleeves of the device for establishing a holding-down force are interlinked through an elastic member which is rigidly coupled to the feed mechanism, while the latter mechanism is capable of damping the movements of the elastic member both in the forward and reverse directions of feed.

Such a construction arrangement enables one to eliminate impact loads due to a permanent contact of the workpieces with the abrasive tool accompanied by creating higher forces applied to the protruding irregularities on the abrasive tool working surface in order to correct the geometric shape of the latter.

The aforesaid object is accomplished also due to the provision of a machine for abrasive treatment, comprising an abrasive tool and a device for establishing a holding-down force within the machining zone, said device having a housing with guideways, wherein poppet sleeves carrying spindles are free to reciprocate so as to translate the holding-down force to the abrasive tool, and a feeding mechanism provided on the housing, according to an equivalent embodiment of the invention, the poppet sleeves of the device for establishing a holding-down force are interlinked through an elastic member which is rigidly coupled to said poppet sleeves, while the feeding mechanism is mechanically associated with the elastic member and is capable of damping the movements of the elastic member both in the forward and reverse directions of feed.

Such a construction arrangement also makes it possible to eliminate impact loads due to a permanent contact of the workpieces with the abrasive tool with simultaneously creating increased forces applied to the protruding irregularities on the working surface of the abrasive tool in order to correct the geometric shape of said surface.

It is expedient that the machine, according to the aforesaid embodiment, be so provided that the elastic member be of a curved shape and be connected to the feed mechanism at a place equidistant from the longitudinal axes of the poppet sleeves.

Such a shape of the elastic member enables one to add to rigidity of the device for establishing a holding-down force, as well as its ability to take up higher loads, with the result that machining accuracy is enhanced, machine production output is increased and its service life is prolonged. Besides, said interconnection of the elastic member with the feed mechanism facilitates machine setting-up.

Thus, the machine for abrasive treatment, according to the present invention, is capable of rather high machining accuracy and quality of abrasive treatment.

BRIEF DESCRIPTION OF THE DRAWINGS

Said specific features and further advantages of the present invention will become more evident from a consideration of the following detailed description of some specific exemplary embodiments there of with reference to the accompanying drawings, wherein.

EMBODIMENTS

Figure 1:
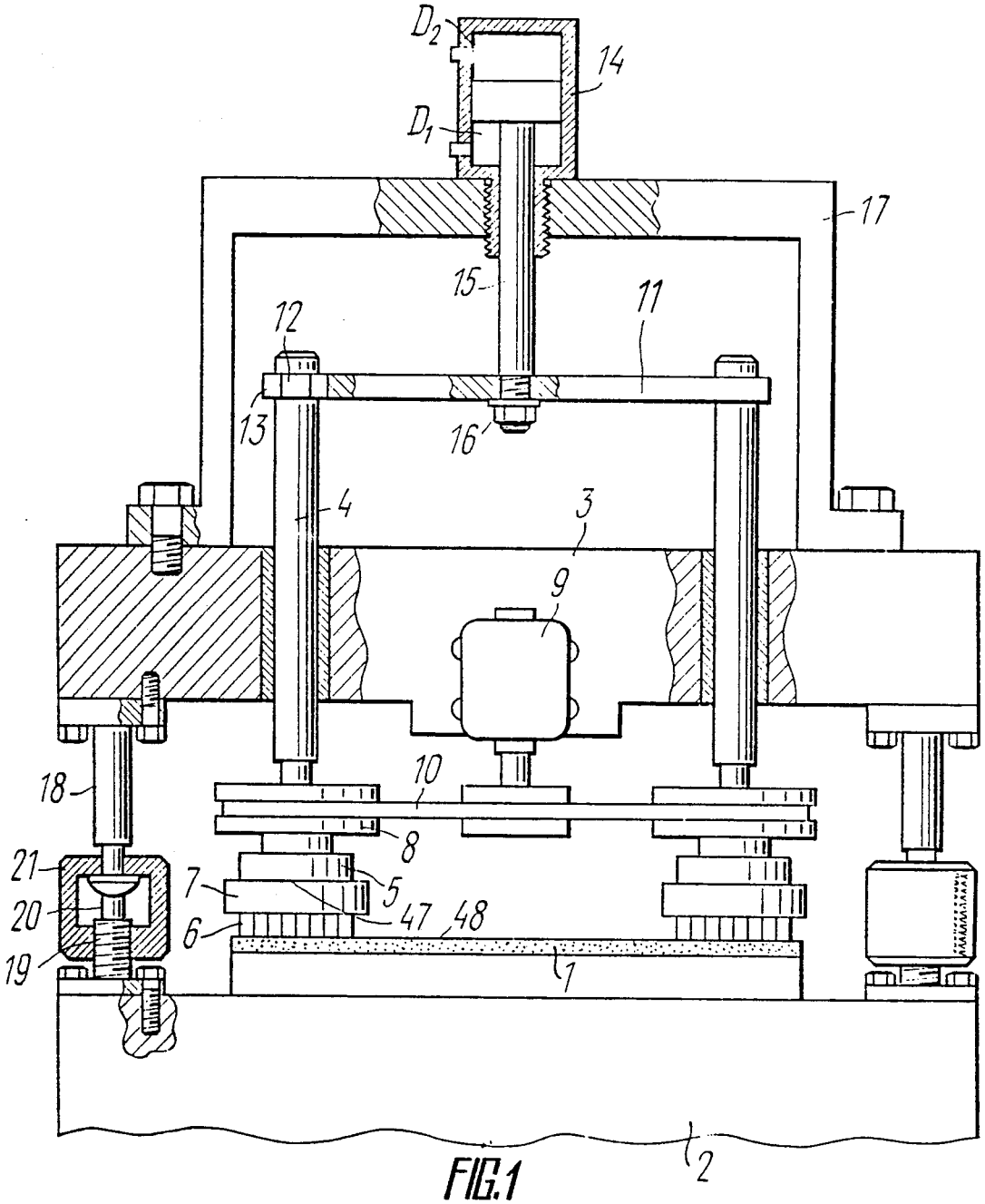
FIG. 1 is a general diagrammatic view of a machine, according to the invention, wherein poppet sleeves are interconnected through an elastic member rigidly coupled to the feed mechanism which is made as an air cylinder.

The machine of the present invention comprises (FIG. 1) an abrasive tool 1 rotatably mounted on a grinding head which in turn is installed on a base 2 (the abrasive tool drive and the grinding head being omitted in the drawing). Poppet sleeves 4 carrying spindles 5 are mounted the guideways of a housing 3 so as to reciprocate therein. Workpieces G are set in holders 7 which are located on the spindles 5 with pulleys 8. A drive 9 is mounted on the housing 3 and connected to the spindles 5 through a belt transmission 10. The poppet sleeves 4 are interlinked through an elastic member 11 made as a flat spring, and are provided with grooves 12 into which are fitted fork-like ends 13 of the elastic member 11 with a possibility of radial motion. The feed mechanism is made as an air cylinder 14 with a rod 15 rigidly coupled to the elastic member 11 by means of nut 16. The air cylinder 14 is adapted to damp the movement of the elastic member 11 in the forward and reverse directions of feed and is fixed on the housing 3 through a bracket 17. The housing 3 is installed on the base 2 through posts 18, stops 19, spacer shims 20 and locking special nuts 21.

Figure 2:
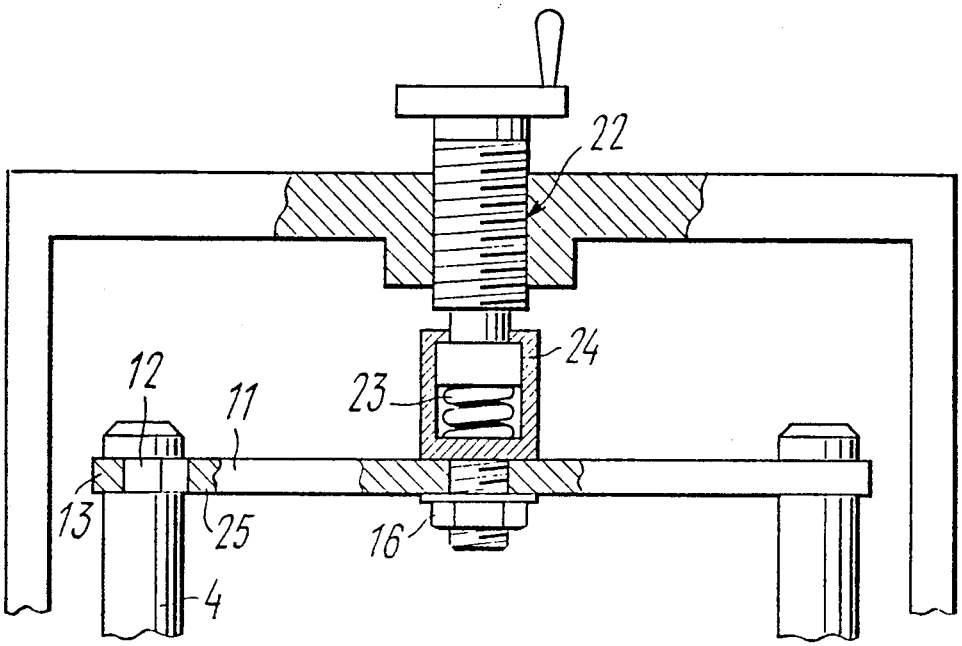
FIG. 2 is a diagrammatic view of the top portion of the device for establishing a holding-down force of the machine, according to the invention, wherein poppet sleeves are interconnected through an elastic member rigidly coupled to the feed mechanism which is made as a screw pair provided with a spring damper.

An alternative embodiment of the feed mechanism (FIG. 2) may be made a screw pair 22 and springs 23 with a possibility of damping the motion of the elastic member 11 in the forward reverse directions of feed. The elastic member 11 is rigidly coupled with a guide sleeve 24 of the spring 23 by means of the nut 16. The ends 13 of the elastic member 11 are fitted into the grooves 12 of the poppet sleeves 4.

Figure 3:
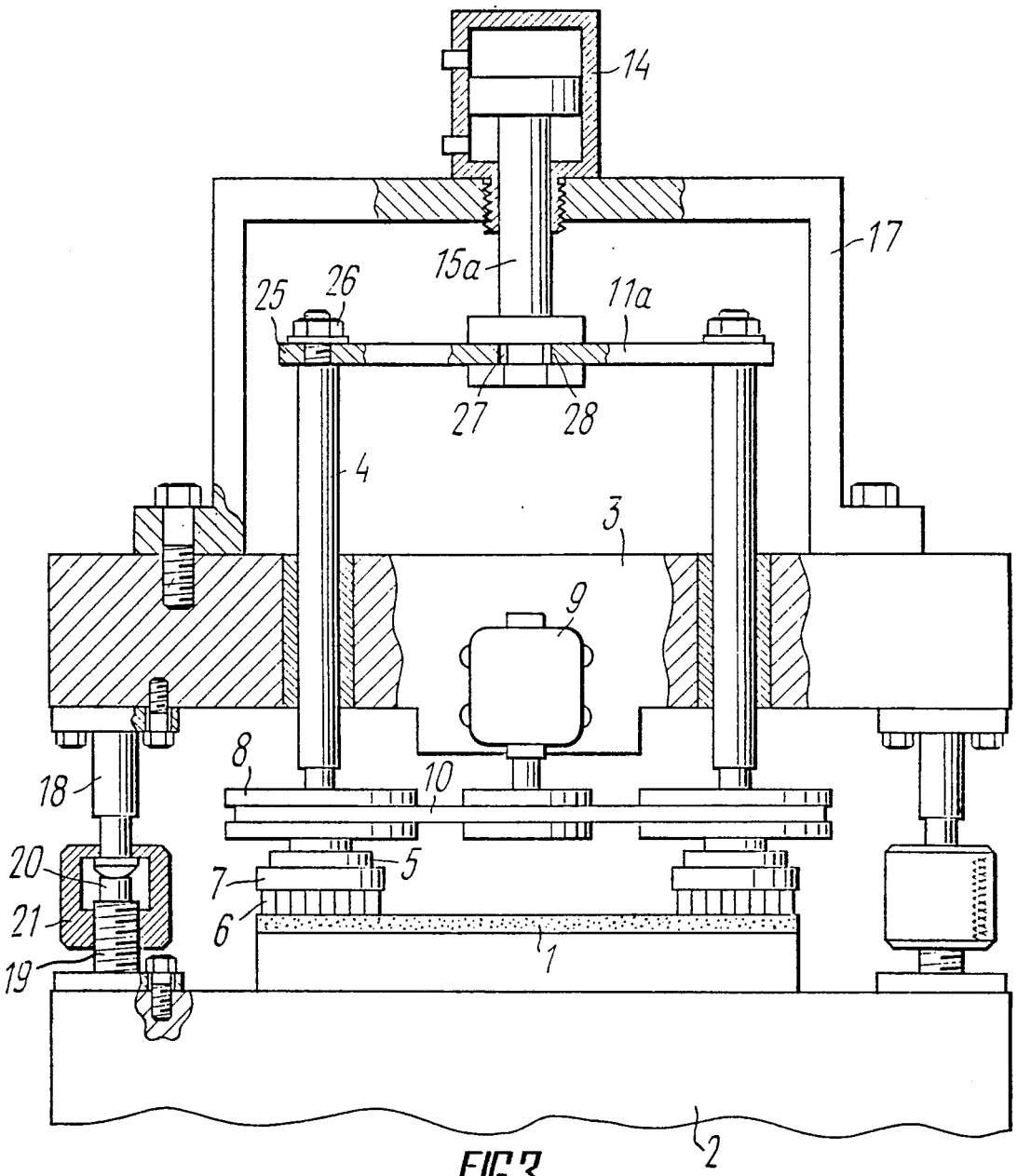
FIG. 3 is a general diagrammatic view of a machine, according to an equivalent embodiment of the invention, wherein poppet sleeves are rigidly coupled to an elastic member which is connected to the feed mechanism so as to move radially.

According to another embodiment shown in FIG. 3 the machine comprises the abrasive tool 1 rotatably mounted on a grinding wheel which in turn is installed on the base 2 (the abrasive tool drive and the grinding head being omitted in the drawing). The poppet sleeves 4 carrying the spindles 5 are reciprocatedly mounted in the guideways of the housing 3. The workpieces 6 are set in the holders 7 which are located on the spindles 5 having the pulleys 8. The drive 9 is mounted on the housing 3 and connected to the spindles 5 through the belt transmission 10. The poppet sleeves 4 are interlinked through at least one elastic member 11*a* which is rigidly coupled to said sleeves through its ends 25 and nuts 26. The feed mechanism made as the air cylinder 14 provided with a rod 15*a*, is adapted to damp the motion of the elastic member 11*a* in the forward and reverse directions of feed and is held to the housing 3 by means of the bracket 17. The rod 15*a* has a groove 27 into which the elastic member 11*a* is fitted by means of a slot 28 with a possibility of radial traversing. The housing 3 is mounted on the base 2 by means of the posts 18, the stops 19 and is fixed in position by the special nuts 21.

Figure 4:
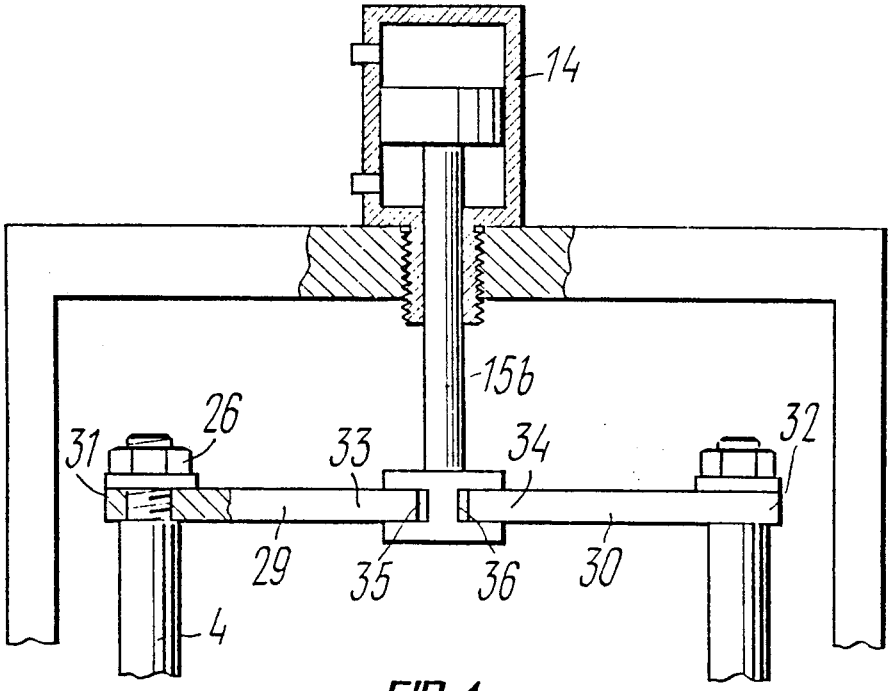
FIG. 4 is a diagrammatic view of the top portion of the device for establishing a holding-down force of the machine, according to the invention, wherein poppet sleeves are rigidly coupled to two elastic members which are connected to the feed mechanism so as to move radially.
Figure 5:
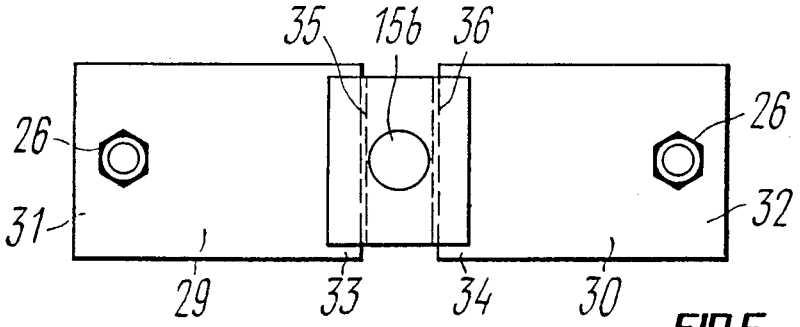
FIG. 5 is a diagrammatic plan view of the machine of FIG. 4 with a feed mechanism attachment bracket out of position.

According to an alternative embodiment of the holding-down device as shown in FIGS. 4, 5 it can incorporate two elastic members 29, 30 rigidly coupled through their respective ends 31, 32 to the poppet sleeves 4 by means of the nuts 26, while their other ends 33, 34 are fitted into slots 35, 36 of a rod 15*b* of the air cylinder 14 with a possibility of radial movement.

Figure 6:
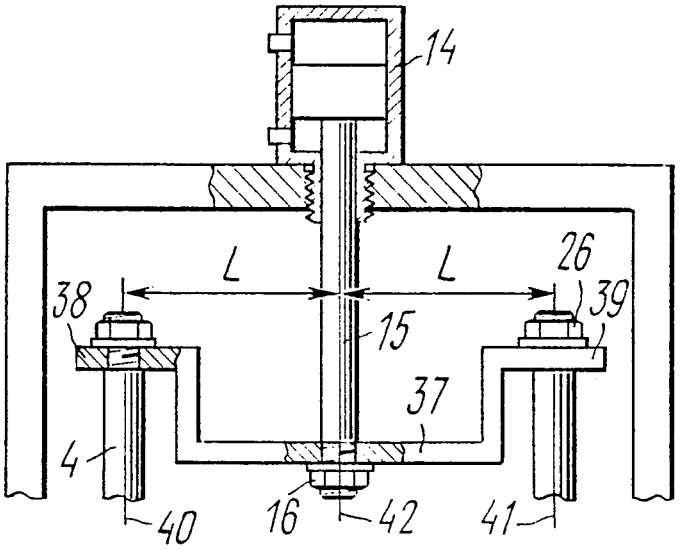
FIG. 6 is a diagrammatic view of the top portion of the device for establishing a holding-down force of the machine, according to the invention, wherein the elastic member is of a curved shape.
Figure 7:
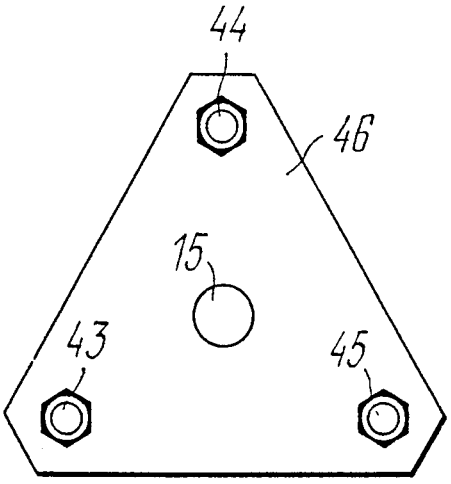
FIG. 7 is a diagrammatic plan view of a machine, according to the invention, incorporating three poppet sleeves.

FIG. 6 illustrates one more embodiment of an elastic member 37 which is made curved and is rigidly coupled through its ends 38, 39 to the poppet sleeves 4 through the nuts 26. The feed mechanism is made as the air cylinder 14 with the rod 15 rigidly coupled to the elastic member 37 at a distance L from longitudinal axes 40, 41 of the poppet sleeves 4 to an axis 42 of the rod 15.

The device for establishing the holding-down force may incorporate three or more poppet sleeves 43, 44, 45 connected to an elastic member 46, with is associated with the rod 15 of the air cylinder (which is omitted in the drawing).

The machine for abrasive treatment, according to the invention, operates as follows.

In order to set the holders 7 carrying the workpieces 6 to be machined, a pressure fluid, e.g., compressed air is fed into the chamber $D_1$ of the air cylinder 14. The rod 15 of the air cylinder 14 translates the force, via the nut 16, to the elastic member II, which with its fork-like ends 13 actuates the poppet sleeves 4 through the grooves 12. The poppet sleeves 4 can traverse along with the spindles 5 and the pulleys 8, in the guideways of the housing 3 in a direction opposite to the working surface of the abrasive tool 1.

Thus, the machine is brought into the initial position. Then locating end faces 47 of the spindles 5 are set at the same level with respect to a working surface 48 of the abrasive tool 1, using any of the heretofore-known techniques suitable for the purpose.

The distance between the locating surfaces 47 of the spindles 5 and the working surface 48 of the abrasive tool 1 which depends on the original thickness of the workpieces 6 being machined is set by arranging the housing 3 with respect to the machine base 2 using the spacer shims 20, which are fitted in between the posts 18 and the stops 19. The housing 3 is fixed in position with respect to the base 2 by the special nuts 21.

With the machine in the initial position the distance from the locating surfaces 47 of the spindles 5 and the working surface 48 of the abrasive tool exceeds the thickness of the holder 7 with the work-pieces 6 contained therein.

Then the abrasive tool 1 is set in rotation by means of its drive (omitted in the drawing). The spindles 5 are set in rotation via the belt transmission 10 and the pulleys 8 from the drive 9. The holders 7 with the workpieces 6 are brought into a gap between the abrasive tool 1 and the spindles 5 using, e.g., any known positioner. Next a pressure fluid is fed into the chamber $D_2$ of the air cylinder 14, whereby the rod 15 of the air cylinder 14 is made to actuate the elastic elements 11, which in turn presses, through its fork-like ends 13, upon the poppet sleeves 4 through the grooves 12. The poppet sleeves 4 are traversed in the guideways of the housing 3 towards the working surface of the abrasive tool 1 along with the spindles 5. As the spindles 5 approach the holders 7 the latter get in contact with the spindles 5 simultaneously with centring their axes, and the workpieces 6 set in the holder 7 get in contact with the working surface 48 of the abrasive tool 1. Thus, the hodling-down force is established in the machining zone and rotation is imparted to the holders 7 carrying the workpices 6 by virtue of friction forces arising between the locating surfaces 47 of the spindles 5 and the surfaces of the holders 7 in contact therewith.

Figure 8:
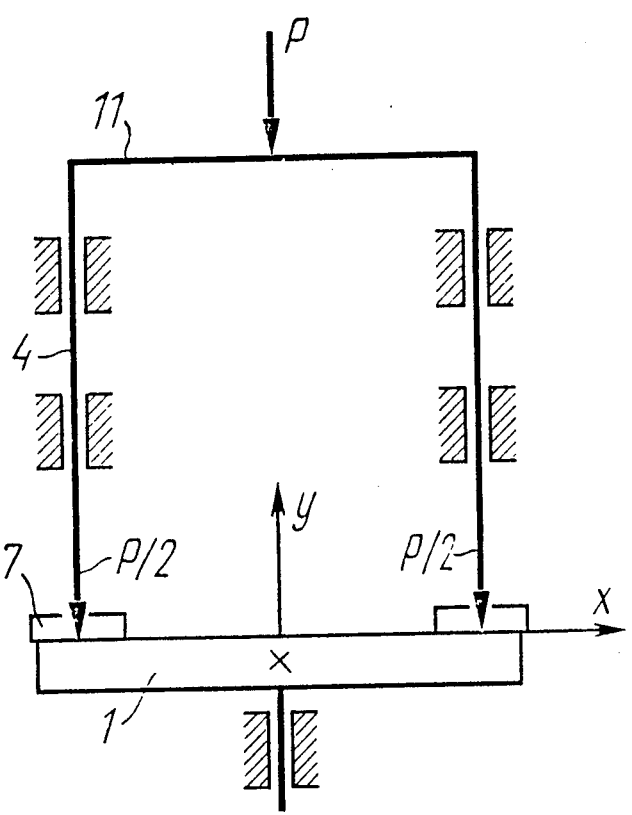
FIG. 8 illustrates a diagram of distribution of the holding-down forces within the machining zone with a correct shape of the abrasive tool working surface.

Should neither departures from an exact geometric shape of the working surface of the abrasive tool 1 nor its axial runout occur, said working surface is to be square with the axis of rotation of the abrasive tool 1 (FIG. 8). Such being the case the elastic member 11 is actuated by the force P of the feed mechanism which is redistributed to the poppet sleeves 4 in the device for establishing the holding-down force within the machining zone. Thus, a force of P/2 is exerted one each of the holders 7 carrying the workpieces 6 and all the holders 7 are at the same level.

Figure 9:
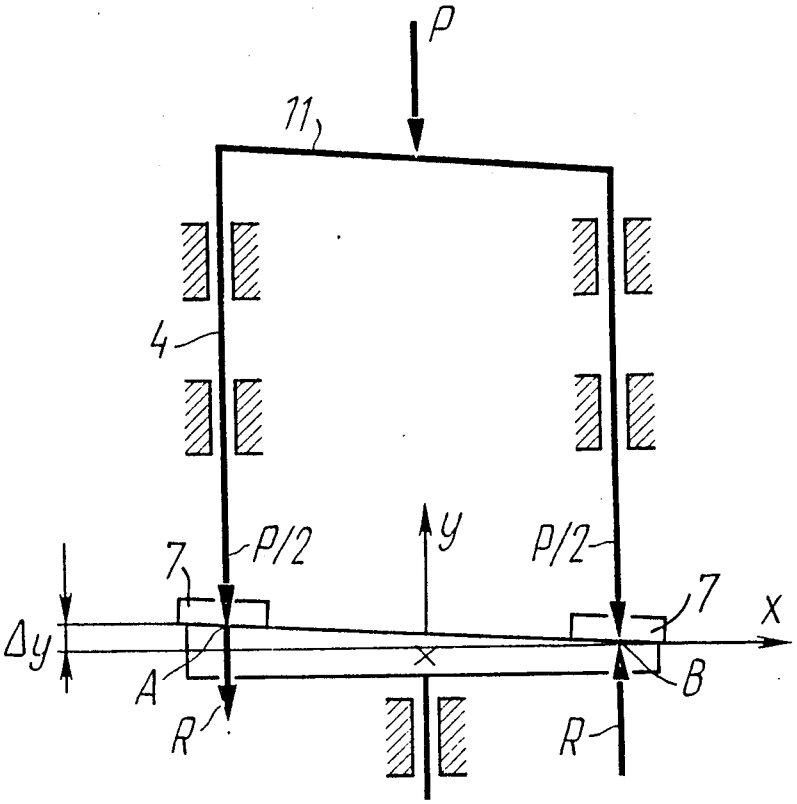
FIG. 9 illustrates a diagram of distribution of the holding-down forces within the machining zone with an axial runout of the abrzsive tool working surface.
Figure 10:
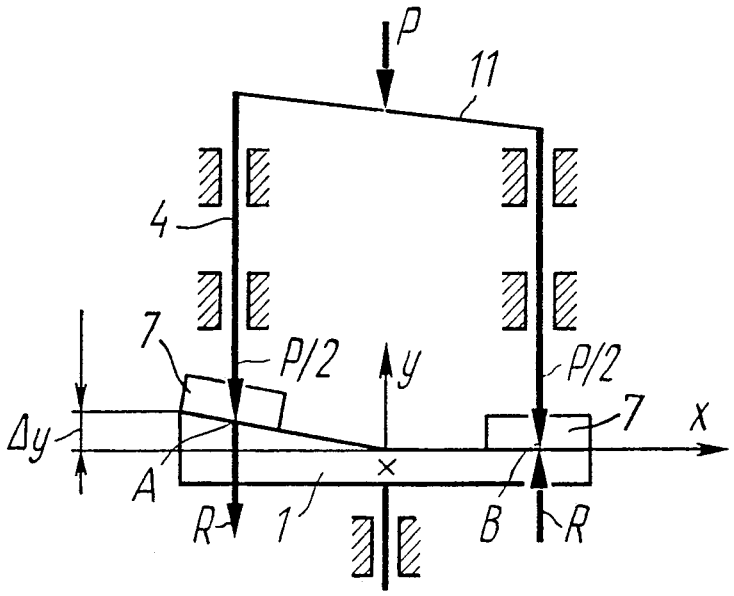
FIG. 10 illustrates a diagram of distribution of the holding-down forces within the machining zone with disturbed flatness of the abrasive tool working surface.

When an axial runout (FIG. 9) or waviness of the working surface of the abrasive tool 1 (FIG. 10) occurs, the elastic member 11 is deformed under the action of the force P and the holders 7 carrying the workpieces 6 are situated at different levels, a difference therebetween being equal to Δ level. The deformation of the elastic member 11 gives rise to reaction forces R, with the result that the direction of the reaction force R on the prominent irregularities of the working surface 48 of the abrasive tool 1 at the point A coincides with the direction of holding-down force P/2 effective in the machining zone, whereas the directions of the aforesaid forces in the depressions of the abrasive tool working surface at the points B are opposite. As a result, since the workpieces 6 being machined are in permanent contact with the abrasive tool 1, the prominent irregularities of the working surface 48 of the abrasive took 1 are exposed to the effect of higher forces, whereby its geometric shape is corrected and or the axial run-out is eliminated. When the abrasive tool 1 is rotating the workpieces 6 are withdrawn, which is facilitated by the damping action of the feed mechanism.

The process for correction of the geometric shape of the working surface 48 of the abrasive tool 1 can be intensified by replacing the workpices 6 being machined by abrasive sticks (omitted in the drawing).

When a rigid holding of the elastic member 11 to the feed mechanism (FIG. 1) is the case, as well as its connection to the poppet sleeves 4 reciprocate in the opposite directions, and in the case of nonparallelism of the axes of the poppet sleeves 4, the elastic member 11 slides, with its ends 13, along the grooves 12 of the poppet sleeves 4.

Such a construction arrangement makes it possible to prolong the reciprocating stroke of the poppet sleeves 4, e.g., when dressing the abrasive tool 1 with abrasive sticks, or when necessity arises in increased idle strokes of the poppet sleeves 4.

The machine for abrasive treatment, according to the invention (FIG. 2) incorporating the device for establishing the holding-down force operates in a way similar to that described above, with the sole exception that the feed motion is effected with the aid of the screw pair 22 and the travel of the elastic member 11 is damped by means of the spring 23.

The present construction arrangement is substantially simple and involves no use of a pressure fluid, e.g., compressed air.

The machine for abrasive treatment, according to the embodiment shown in FIG. 3 operates in a way similar to that described above with the sole exception that the force developed by the air cyclinder 14 is translated to the elastic member 11*a* by the rod 15*a* which engages, through the groove 27 provided at its end, into the slot 28 of the elastic member 11*a*. The latter in turn relates the forces to the poppet sleeves 4 through its ends 25 rigidly coupled to sais poppet sleeves 4 by the nuts 26.

The aforedescribed construction is mostly applicable in the case of a comparatively short strokes of the poppet sleeves 4 and with the parallelism of the longitudinal axes thereof, due to the provision of high rigidity of the device for establishing the holding-down force.

The machine for abrasive treatment, according to the invention, provided with the device for establishing the holding-down forces as shown in FIGS. 4, 5 operates in a way similar to that described above with reference to FIG. 3 with the sole exception that provision of the two elastic members 29, 30 and their association with the rod 15*b* via the slots 35, 36 provides a possibility for radial movement of the ends 33, 34 of the respective elastic members 29, 30 with respect to the longitudinal axes of the poppet sleeves 4.

Such a constructional arrangement likewise makes it possible to increase the reciprocating stroke of the poppet sleeves 4, if necessary.

FIG. 6 illustrates the device for establishing the holding-down force within the machining zone of the machine for abrasive treatment, according to the invention, featuring the elastic member 37 curved in shape.

Figure 11:
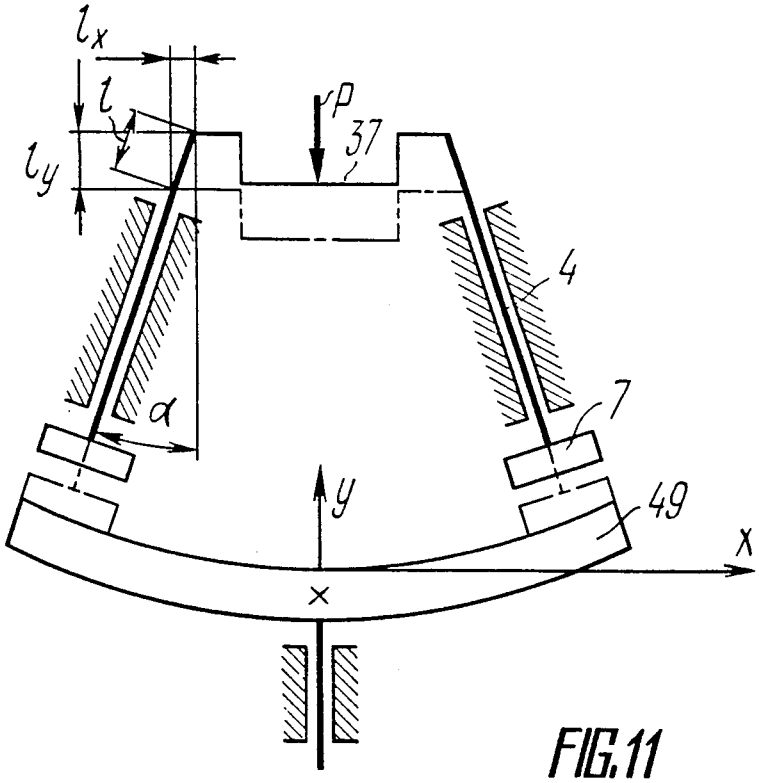
FIG. 11 illustrates a diagram of machining a spherical surface.

The operation of the given embodiment of the device is similar to the described above. In addition, when the axes of the poppet sleeves 4 make up an angle $\alpha$ (FIG. 11) with the vertical, which is the case when machining workpieces having a spherical surface or dressing the spherical working surface of an abrasive tool 49, the ends of the poppet sleeves 4 which are rigidly coupled to the elastic member 37 are free to travel for a distance l lengthwise the axis of the poppet sleeves 4 having respective projections $l_X$ and $l_y$ onto the axes X and Y, respectively. In this case $l_x$ is in fact the length of travel of each end of the elastic member 37, thereby adding to the length of said member by the value of $2l_x$ due to deformation of the curved member 37 lengthwise the axis X.

Practical application of the machine, according to the invention, provided with the device for establishing the holding-down force having three or more poppet sleeves makes it possible to enhance its production output due to an increased number of working spindles and to intensify correction of the geometric shape of the abrasive tool working surface due to an increased number of contacts between the work-pieces or abrasive sticks and the prominent irregularities on the abrasive tool surface.

The present invention is by no means bounded to the aforedescribed specific exemplary embodiments thereof but covers a variety of alterations and changes that may happen to be within the framework of the scope of claims that follow.

Industrial Applicability

The present invention can find most efficient application when used for diamond grinding, lapping and polishing of flat or spherical surfaces of workpieces from hard and brittle materials, such as metal-cermet and sintered-arbide alloys, structural and radio-engineering ceramics, single crystals, optical glass, and the like.

What is claimed is:

1. A machine for abrasive treatment, said machine comprising an abrasive tool, a device for establishing a holding-down force between workpieces and the abrasive tool within a machining zone, said device having a housing with guideways, wherein poppet sleeves each carrying a spindle mounting one of said workpieces are free to reciprocate so as to translate the holding-down force to the abrasive tool, and a feed mechanism located on the housing, said poppet sleeves being rigidly interconnected through an elastic member, said elastic member also being rigidly coupled to said feed mechanism, while said feed mechanism is adapted to damp travel of said elastic member in forward and reverse directions of feed.

2. A machine for abrasive treatment, comprising an abrasive tool and the device for establishing a holding-down force between workpieces and the abrasive tool within a machining zone, said device having a housing with the guideways, wherein poppet sleeves each carrying a spindle mounting one of said workpieces are free to be reciprocated so as to translate the holding-down force to the abrasive tool, and a feed mechanism located on the housing, the poppet sleeves being interlinked through at least one elastic member rigidly coupled to said poppet sleeves, while the feed mechanism is also rigidly coupled with the elastic member and is adapted to damp the travel of the elastic member in the forward and reverse directions of feed.

3. A machine as claimed in claim 2, wherein the elastic member has a curved shaped and is connected to the feed mechanism at a place equidistant to the longitudinal axes of the poppet sleeves.

* * * * *